US005363949A

United States Patent [19]

Matsubayashi

[11] Patent Number: 5,363,949

[45] Date of Patent: Nov. 15, 1994

[54] BILL RECOGNIZING APPARATUS

[75] Inventor: Katsuyoshi Matsubayashi, Yamanashi, Japan

[73] Assignee: NEC Corporation, Tokyo, Japan

[21] Appl. No.: 992,723

[22] Filed: Dec. 18, 1992

[30] Foreign Application Priority Data

Dec. 18, 1991 [JP] Japan ..... 3-353878

[51] Int. Cl.[5] ..... G07D 7/00

[52] U.S. Cl. ..... 194/206; 382/7

[58] Field of Search ..... 194/206, 207; 209/534; 382/7

[56] References Cited

U.S. PATENT DOCUMENTS 4,179,685 12/1979 O'Maley ..... 382/46 X 4,487,306 12/1984 Nao et al. ..... 194/207

4,984,280 1/1991 Abe ..... 382/7

5,199,543 4/1993 Kamagami et al. ..... 209/534 X

*Primary Examiner*—F. J. Bartuska

*Attorney, Agent, or Firm*—Sughrue, Mion, Zinn, Macpeak & Seas

[57] ABSTRACT

Image data from a transported bill is read in response to a sampling clock and is stored. A clock generator generates a master clock faster than the sampling clock. The degree of skew of the bill is calculated in synchronism with the master clock. The stored image data is then corrected with the results of the skew calculation. The skew-corrected image data is then compressed and compared with predetermined dictionary data in order to recognize the bill.

2 Claims, 5 Drawing Sheets

BILL RECOGNIZING APPARATUS

BACKGROUND OF THE INVENTION

The present invention relates to a bill recognizing apparatus for recognizing and processing the sample data read from bills.

In the prior art bill(paper money) recognizing system, a main sensor section in a bill recognizing apparatus performs data sampling of a bill in synchronism with an encoder pulse. In the data sampling, a skew detection is made when the bill has been fed as long as 24 mm from the edge into the image sensor section.

Depending on the skew condition, the address is determined to transfer the data sampled by the image sensor section for initiating DMA (direct memory access) operation in synchronism with the encoder pulse. In other words, the DMA operation corrects the skew of the data sampled by the image sensor section.

When completing transfer of all sampled data by the DMA operation, a CPU (microprocessor) software performs the following: the read-out processing of the sampled data from the transferred address (read-out processing of the skew corrected data); the compression processing for extracting the features in the data; and the reference processing with the compressed data and the dictionary data of various bills (28 kinds of dictionary data). As a result, the kind of bill in the dictionary data closest to the sampled data is determined.

The feed time of the 24 mm required for skew correction and the time required for complicated and repeated software processing results in delay for recognizing the correct kind of bill. Also, a longer distance is required for the mechanism to switch the transportation path depending on the recognition of the bill. As a result, it was difficult to miniaturize a bill recognizing apparatus.

In the conventional bill recognizing system, a common counter is used for generating an address for temporary storage of the sampled data and an address for DMA operation for skew correction. Accordingly, the DMA operation is performed in response to the encoder pulse which is a timing pulse for sampling the data of every 1 mm of the bill at its feed rate.

The time required for recognizing the skew condition and correcting the skew at the 24 mm position of the bill from the front edge affects until all sampled data is transferred and the DMA operation is completed. This causes a path to transport the bill during the above mentioned time.

For example, in the case of a 1500 mm/s feed rate, the time required for determining the skew correction factor is 16 ms, an additional 60 ms is required for software processing is 60 ms. As a result, the feed path for the bill for a total 76 ms is long as about 2,114 mm.

SUMMARY OF THE INVENTION

It is therefore an object of the present invention to overcome the aforementioned problems of the prior art and to provide a compact bill recognizing apparatus with shorter processing time to recognize the bill.

The bill recognizing apparatus according to the present invention comprises storage means to store the image data read from the transported bill in response to a sampling clock, clock generator means to generate a master clock faster than the sampling clock, calculation means to calculate the degree of skew of the bill in synchronism with the master clock generated by the clock generator means, skew correction means to correct the skew of the image data stored in tile storage means in response to the calculation result of the calculation means and operating in synchronism with tile master clock generated by the generation means, compression means to compress the image data skew corrected by the skew correction means and operating in synchronism with the master clock generated by the clock generator means, and comparator means to compare the compressed image data from the compression means with the predetermined dictionary data, thereby recognizing the bill based on the comparison result from the comparison means operating in synchronism with the master clock.

Other objects and features will be clarified from the following description with reference to the attached drawings.

DESCRIPTION OF PREFERRED EMBODIMENTS

Now, a preferred embodiment of the present invention will be described in detail hereunder by reference to the accompanying drawings.

Figure 1:
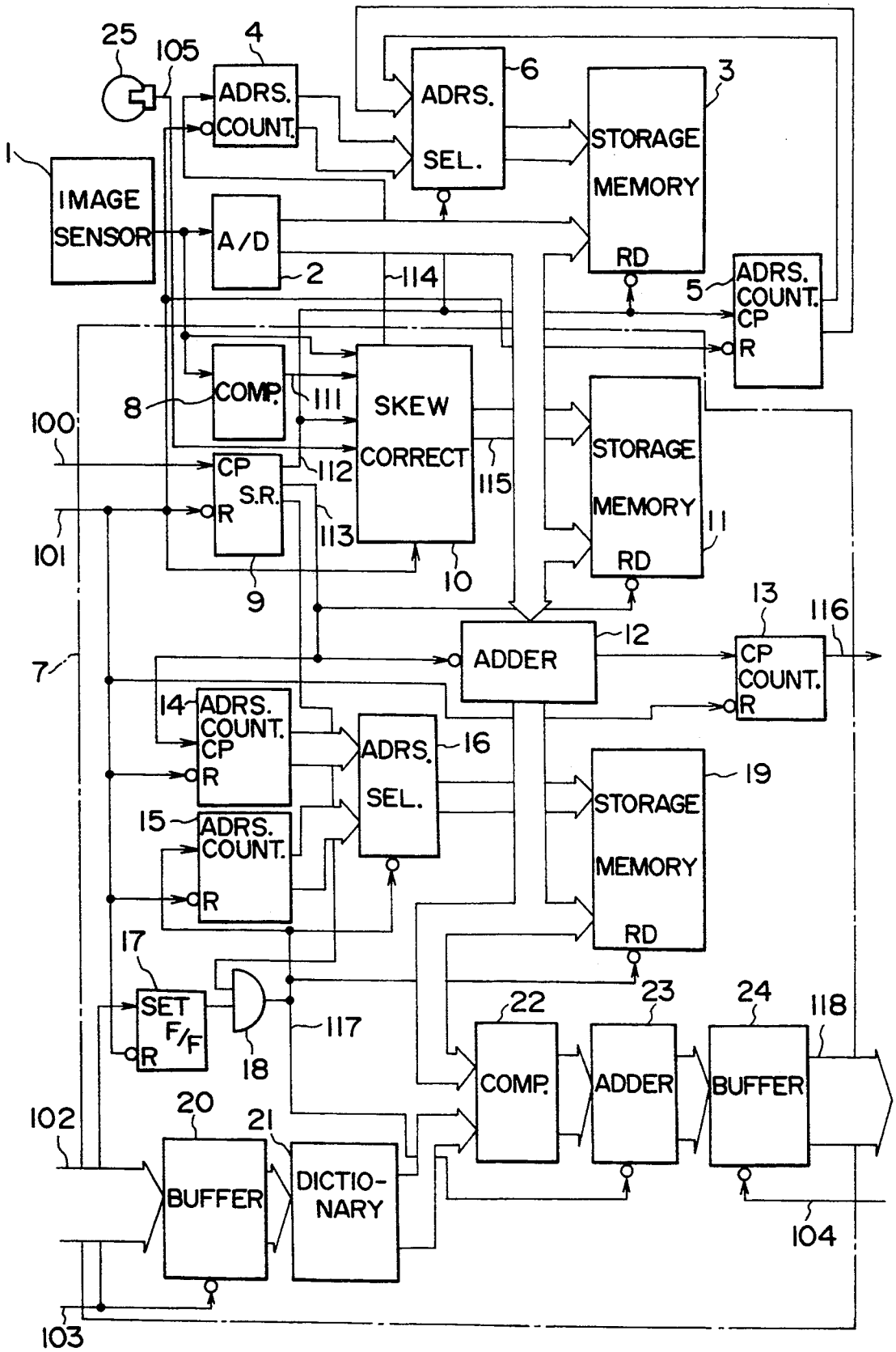
FIG. 1 is a block diagram of one embodiment of the bill recognizing apparatus according to the present invention.

Illustrated in FIG. 1 is a block diagram of a preferred embodiment of the present invention. In the preferred embodiment in FIG. 1, a bill recognizing hardware circuit 7 is designed to operate in synchronism with a high speed master clock signal 100 for bill recognition.

An image sensor 1 temporarily stores in a bill sample data storage memory (referred to as a storage memory below) 3 the data sampled by the bill (not shown) in synchronism with an encoder pulse by way of an A/D (analog-to-digital) converter 2. The storage memory 3 receives an address from a bill sample data storage address generation counter (referred to as an address counter) 4 selected by a bill sample data storage/read-out time selector (referred to as an address selector below) 6. The address counter 4 generates a bill sample data plant address based on a bill image data sample signal 114 from a skew correction circuit 10 in the bill recognizing circuit 7. The address counter 4 can be reset by a bill recognizing processing start signal 101 to be generated when the front edge of a bill is fed into the bill recognizing apparatus.

When data sampling is being performed by the image sensor 1, the skew condition of the bill is recognized by the skew correction circuit 10 in the bill recognition circuit 7. That is, a bill presence/absence signal 111 is applied to the skew correction circuit 10 from a bill presence/absence signal generation analog comparator (referred to as an analog comparator below) 8. Also applied to the skew correction circuit 10 is a bill sample data read-out signal 112 from a shift register for generating a master clock for skew correction compression processing operation (referred to as a shift register below) 9. The bill recognizing processing start signal 101 is applied to the skew correction circuit 10 when the front edge of a bill is fed into the bill recognizing apparatus. Additionally, applied to the skew correction circuit 10 is an encoder pulse signal for bill Image data sampling timing (referred to as an encoder pulse signal below) 105 from an encoder for generating a bill data sample timing signal (referred to as an encoder below) 25.

The skew correction circuit 10 recognizes the skew condition of the bill in response to these input signals and generates a skew correction constant to determine the address to transfer the data sampled by the image sensor 1.

The analog comparator 8 generates the bill presence/absence signal 111 from the data sampled by the image sensor 1. The shift register 9 generates the bill sample data read-out signal 112 in response to the master clock signal 100 for bill recognizing operation from a clock generator circuit (not shown) and a bill sample data read-out signal 113 after skew correction. The shift register 9 is reset by the bill recognizing processing start signal 101 to be applied thereto when the front edge of a bill is fed in the bill recognizing apparatus.

The plant memory 3 receives from the shift register 9 the bill sample data read-out signal 112 in synchronism with the master clock signal 100 for the bill recognizing operation and outputs the temporarily stored bill sample data to a skew corrected bill sample data storage memory (referred to as a storage memory below) 11. Supplied to the storage memory 3 is an address from a bill sample data read-out address generator counter (referred to as an address counter below) 5 selected by the address selector 6. The address counter 5 generates a bill sample data read-out address based on the bill sample data read-out signal 112 from the shift register 9 and is reset by the bill recognizing processing start signal 101 to be generated when the front edge of the bill is fed in the bill recognizing apparatus.

The bill sample data from the storage memory 3 is stored in the storage memory 11 at the address designated by the skew corrected bill sample data writing address 115 from the skew correction circuit 10. In this manner, the bill sample data temporarily stored in the storage memory 3 is restored in the storage memory 11 for skew correction of the bill sample data.

When the skew corrected bill sample data read-out signal 113 is applied from the shift register 9 in synchronism with the master clock signal 100 for bill recognizing Operation, the storage memory 11 outputs the skew corrected bill sample data to a bill sample data compression adder (referred to as an adder below) 12.

The adder 12 compresses and adds the skew corrected bill sample data from the storage memory 11 for extracting the features. The adder 12 outputs the compressed bill compressed sample data to a compressed bill sample data plant memory (referred to as a storage memory) 19. Whenever the adder 12 adds and compresses the skew corrected bill sample data, it outputs a signal to indicate data compression to a counter to generate the bill compression processing completion signal (referred to as a counter below) 13. The counter 13 counts the signal from the adder 12 until reaching a predetermined number (representing the termination of compression of the bill sample data) when sending a bill compression processing completion signal 116 to a CPU (not shown). It is to be noted that the counter 13 is reset by the bill recognizing processing start signal 101 to be generated when the front edge of the bill is fed to the bill recognizing apparatus.

In the storage memory 19, the compressed bill sample data from the adder 12 is stored at the address designated by the compressed bill sample data storage address from a compressed bill sample data storage address generation counter (referred to as an address counter below) 14 selected by a compressed bill sample data storage/read-out time switching selector (referred to as an address selector below) 16. The address counter 14 generates the compressed bill sample data storage address based on the skew corrected bill sample data read-out signal 113 from the shift register 9. It is reset by the bill recognizing processing start signal 101 to be generated when the front edge of the bill is fed to the bill recognizing apparatus.

The storage memory 19 outputs to the comparator circuit 22 the compressed bill sample data read out of the address designated by the compressed bill sample data read out address from a compressed bill sample data read-out address generation counter (referred to as an address counter below) 15 selected by the address selector 16 when the bill compressed data read-out signal 117 is received from the AND gate 18. The address counter 15 generates the bill compressed sample data read-out address based on the bill compressed data read-out signal 117 from the AND gate 18 and is reset by the bill recognizing processing start signal 101 to be generated when the front edge of the bill is fed to the bill recognizing apparatus.

A bill evaluation generation timing signal from a bill evaluation generation timing signal generation circuit (F/F) 17 and the signal from the shift register 9 are ANDed by the AND gate 18. The output from the AND gate 18 is derived as a bill compressed data read-out signal 117. The bill evaluation generation timing signal generation circuit 17 generates a bill evaluation generation timing signal in response to the dictionary data reference start signal 103 from the CPU and is reset by the bill recognizing processing start signal 101 to be generated when the front edge of the bill is fed to the bill recognizing apparatus.

When the bill compression processing completion signal 116 is supplied from the counter 13, the CPU output to the buffer 20 a reference parameter 102 to select the dictionary data such as the front or rear of the 1,000 yen bill, the front of 10,000 yen bill, etc. Also, outputted is the dictionary data reference start signal 103 to the bill evaluation generation timing signal generation circuit 17 and the buffer 20. The buffer 20 stores the reference parameter 102 from the CPU when the dictionary data reference start signal 103 is received. Stored in the dictionary data storage memory (ROM) 21 are dictionary data of various bills and such dictionary data corresponding to the reference parameter from the buffer 20 is supplied to the comparator circuit 22.

The comparator circuit 22 subtracts the compressed bill sample data from the storage memory 19 and the dictionary data from the dictionary data storage memory 21 to compare the compressed bill sample data and the dictionary data. The comparator circuit 22 outputs the comparison results to the adder 23 which obtains the sum of the comparison results of all of the bills. The comparison results from the adder 23 are supplied to the buffer 24 as the bill evaluation value.

All evaluation values of the bill sample data with the dictionary data for all of the bills are stored in the buffer 24. When the evaluation read-out signal 104 is received from the CPU, the buffer 24 transfers the evaluation data 118 of the bill sampling data with all of the dictionary data to the CPU. A sorting processing will be carried out by the CPU for the evaluation data 118 from the buffer 24 to determine the particular kind of the bill.

Figure 2:
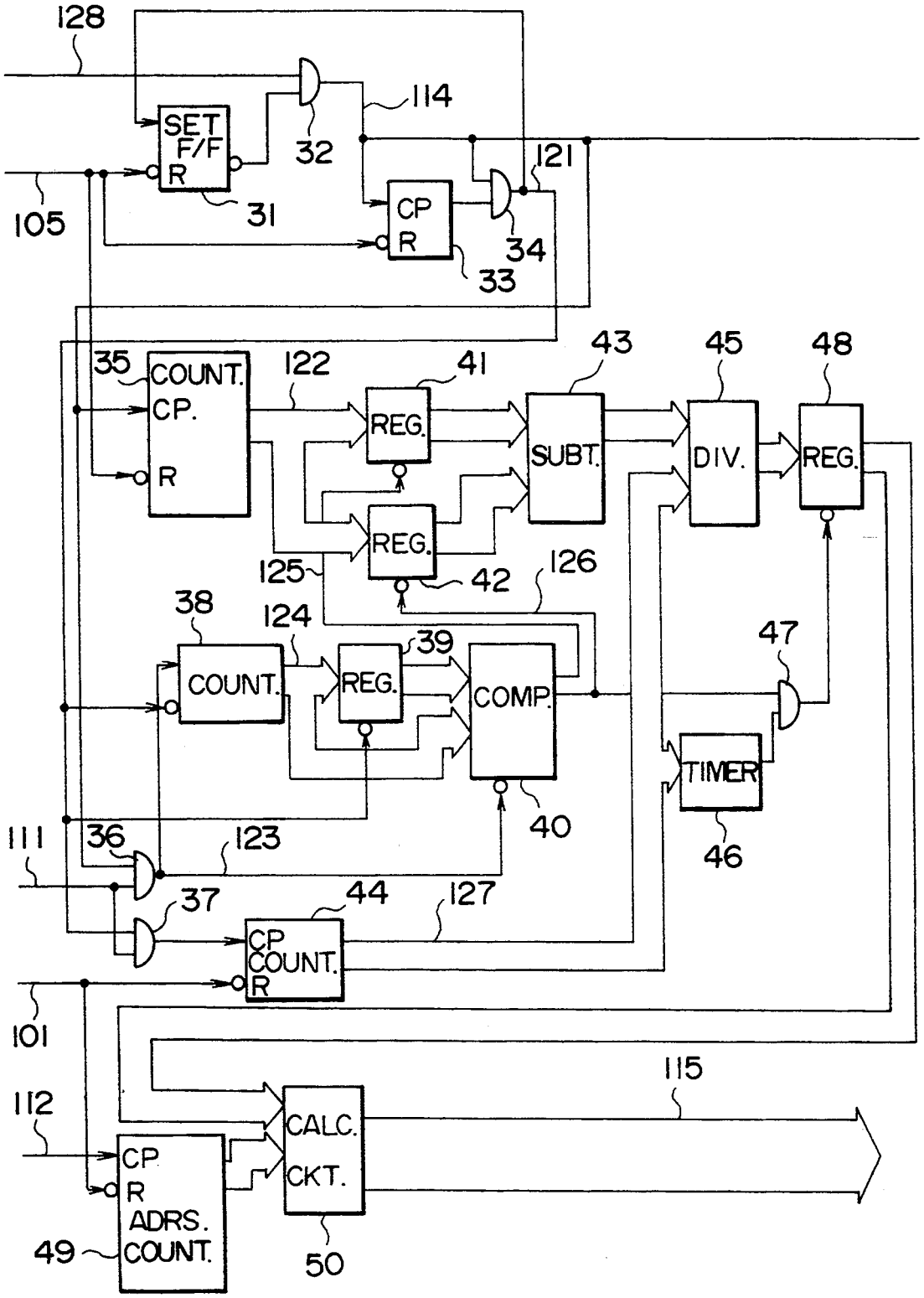
FIG. 2 is a block diagram of the skew correction circuit in FIG. 1.
Figure 3:
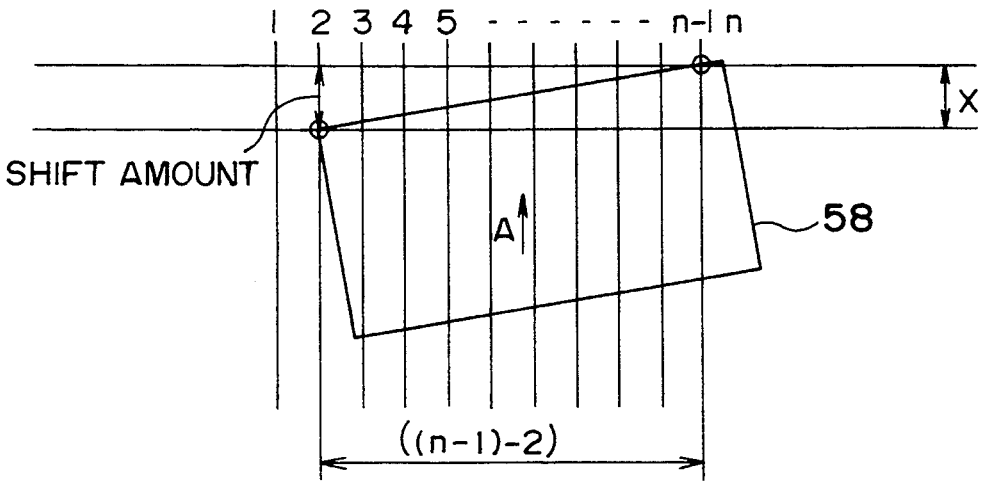
FIG. 3 is an explanatory drawing for generating the skew correction factor by the skew correction circuit in FIG. 2.

Illustrated in FIG. 2 is a block diagram for the skew correction circuit 10 in FIG. 1. FIG. 3 is an explanatory drawing for operation of the skew correction constant by the skew correction circuit 10 in FIG. 1. In FIGS. 2 and 3, the skew correction circuit 10 starts the address generation operation for skew correction simultaneously with the writing operation of the bill sampling data sampled by the image scanner 1 into the storage memory 3.

In other words, whenever the encoder pulse signal 105 is applied from the encoder 25, the flip-flop (referred to as an F/F below) 31 in the skew correction circuit 10 is reset and the output "1" is supplied to the AND gate 32 from the F/F 31.

The image data output timing signal 128 to represent the output timing of the image data to be supplied to the A/D converter 2 from each head (not shown) of the image sensor 1 and the inverted output from the F/F 31 are ANDed by the AND gate 32. The output from the AND gate 32 is applied to the counter 33, the AND gate 34, 36 and a bill image sensor horizontal line sample counter (referred to as a sample counter below) 35 as the bill image data sample signal 114. That Is, whenever the image data is supplied to the A/D converter 2 from each head of the image sensor 1, the "1" output is generated from the AND gate 32 as the bill image data sample signal 114.

The counter 33 counts the bill image data sample signal 114 from the AND gate 32 and generates the "1" output to the AND gate 34 when the count reached a predetermined value (equal to the number of heads of the image sensor 1). It is to be noted that the counter 33 is reset by the encoder pulse signal 105 from the encoder 25.

ANDed by the AND gate 34 is the bill image data sample signal 114 from the AND gate 32 and the signal from the counter 33. The ANDed output from the AND gate 34 is applied to both of the AND gate 37, the counter 38 and the register 39 as the horizontal line sample and signal 121 of the bill.

The sample counter 35 counts the bill image data sample signal 114 from the AND gate 32 and outputs the count value to the registers 41, 42 as the bill image sensor head address data 122. The sample counter 35 is reset by the encoder pulse signal 105 from the encoder 25.

The bill presence/absence signal 111 from the analog comparator 8 and the bill image data sample signal 114 from the AND gate 32 are ANDed by the AND gate 36. The output from the AND gate 36 is applied to the counter 38 and the digital comparator 40 as the sample data comparison timing signal 123 for the bill.

ANDed by the AND gate 37 are the bill presence/absence signal 111 from the analog comparator 8 and the horizontal line sample end signal 121 from the AND gate 34. The output from the AND gate 34 is applied to a bill transfer distance counter (referred to as a vertical width counter below) 44.

The counter 38 counts the sample data comparison timing signal 123 from the AND gate 36. Its count value is applied to the register 39 and the digital comparator 40 as the horizontal width data 124 when the bill passes the image sensor 1. The counter 38 is reset by the horizontal line sample end signal 121 from the AND gate 34.

The register 39 holds the count value of the counter 38 at the input timing of the horizontal line sample end signal 121 from the AND gate 34 and the held count is applied to the digital comparator 40.

The digital comparator 40 compares the horizontal width data 124 from the counter 38 and the content in the register 39 at the input timing of the sample data comparison timing signal 123 from the AND gate 36. As a result, if the horizontal width data 124 from the counter 38 is one or larger when the content in the register 39 is 0, the digital comparator 40 outputs the edge detection signal 125 to the register 41 to indicate that the bill has covered the image sensor 1.

Also, when the content in the register 39 and the horizontal width data 124 from the counter 38 are equal to each other, the digital comparator 40 outputs to the register 42 and the AND gate 47 the maximum detection signal 126 representing that the horizontal width of the bill is detected to have reached the maximum value by the image sensor 1.

The register 41 holds the bill image sensor head address data 122 from the sample counter 35 at the input timing of the edge detection signal 125 from the digital comparator 40. The content held in the register 41 is supplied to the subtraction circuit 43.

The subtraction circuit 43 subtracts the contents held in the registers 41, 42 before supplying the subtraction to the divider circuit 45. As shown in FIG. 3, let the head address be, for example, $(n-1)$ when the edge of the bill 58 has passed the image sensor 1 while the head address is 2 when the horizontal width of the bill 58 is detected to be maximum by the image sensor 1. The subtraction circuit 43 applies $[(n-1)-2]$ to the divider circuit 45.

The vertical width counter 44 counts the output signal from the AND gate 37 to apply the counted value to the divider circuit 45 and the skew monitoring timer 46 as the bill vertical width counter data 127. The vertical width counter 44 is reset by the bill recognizing processing start signal 101 to be generated when the edge of the bill is fed.

The divider circuit 45 calculates the division of the subtracted result from the subtraction circuit 43 and the bill vertical width counter data 127 from the vertical width counter 44. The result of the division the skew correction constant (offset value) is supplied to the register 48. In case of FIG. 3, the input from the subtraction circuit 43 is $[(n-1)-2]$ and the input X of the bill vertical width counter data 127 is derived from the vertical width counter 44, thereby outputting $[(n-1)-2]/X$ from the divider circuit 45 as the skew correction constant.

The skew monitoring timer 46 monitors the bill vertical width counter data 127 from the vertical width counter 44. If the bill vertical width counter data exceeds the predetermined value, "0" output is derived from the AND gate 47. In other words, the skew monitoring timer 46 detects if the skew of the bill exceeds the predetermined value. If the skew exceeds the predetermined value, no skew correction is performed.

The maximum detection signal 126 from the digital comparator 40 and the detection signal from the skew monitoring timer 46 are ANDed by the AND gate 47 to output the AND result to the register 48.

The register 48 holds the divided result from the divider circuit 45 in response to the output from the AND gate 47 and the content held in the register 48 is supplied to the calculation circuit 50 as the skew correction constant. The calculation circuit 50 outputs the skew corrected bill sample data writing address 115 by adding the bill sample data writing address from a bill sample data writing address generation counter (referred to as an address counter below) 49 to the skew correction constant from the register 48.

The address counter 49 counts the bill sample data read-out signal 112 from the shift register 9 and outputs the count value to the calculation circuit 50 as the bill sample data writing address. The address counter 49 is reset by the bill recognizing processing start signal 101 to be generated when the bill edge is fed.

Figure 4:
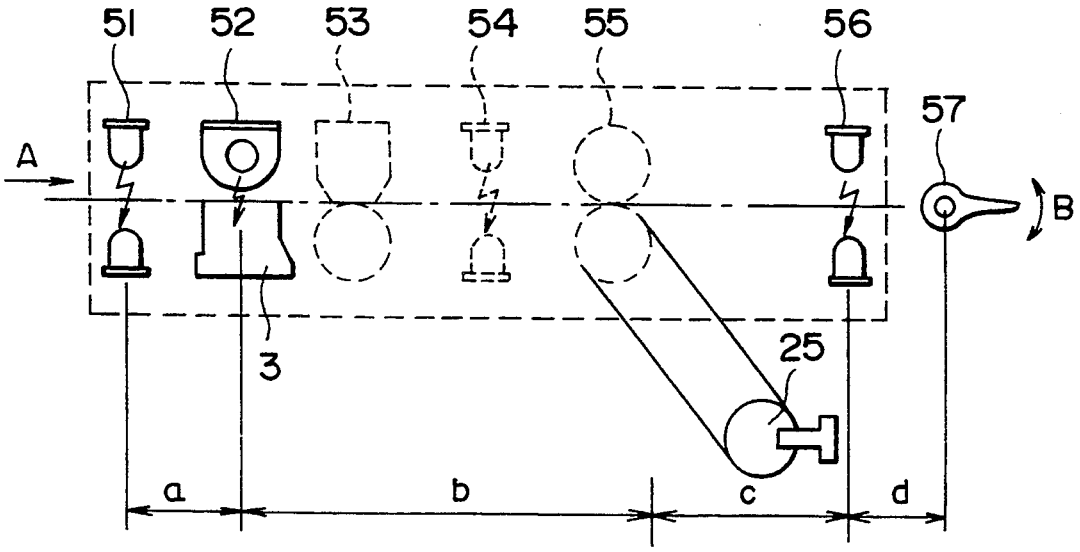
FIG. 4 is a schematic illustrating one embodiment of the bill recognizing apparatus according to the present invention.

FIG. 4 shows a schematic of one embodiment of the bill recognizing apparatus according to the present invention. In FIG. 4, a photo sensor for generating the bill recognizing processing start signal (referred to as a photo sensor below) 51 in the bill recognizing apparatus generates the bill recognizing processing start signal 101 to the bill recognizing circuit 7 when detecting the edge of the bill.

The image sensor 3 performs sampling of the image data of the bill to be transported in the direction of arrow A by directing the light from a solid state light source 52. The sampled image data is supplied to the A/D converter 2 and the bill recognizing circuit 7. Subsequently, the magnetic data on the bill is read by a magnetic sensor 53.

A bill thickness detection roller 55 detects the thickness of the bill in response to the signal from a photo sensor 54 for generating a bill thickness detection start/-completion signal. Coupled to the bill thickness detection roller 55 is an encoder 25 to generate the encoder pulse signal 105 in synchronism with the rotation of the bill thickness detection roller 55. The encoder pulse signal 105 is applied to the bill recognizing circuit 7.

A bill feeding path switching valve 57 rotates in the direction of arrow B in response to the photo sensor 56 for generating the signal indicating completion of the bill recognition and initiation of the bill feed path switching valve for switching the feed path (not shown) for the particular bill.

In FIG. 4, represented by the reference symbol a is the bill skew margin distance, b is the bill image data sample time (bill vertical width), c is the feed time required for the skew correction of the bill image data, the reference processing between the compressed data and the dictionary data and the software sorting processing, and d is the operation time for the bill feed path switching valve.

Figure 5:
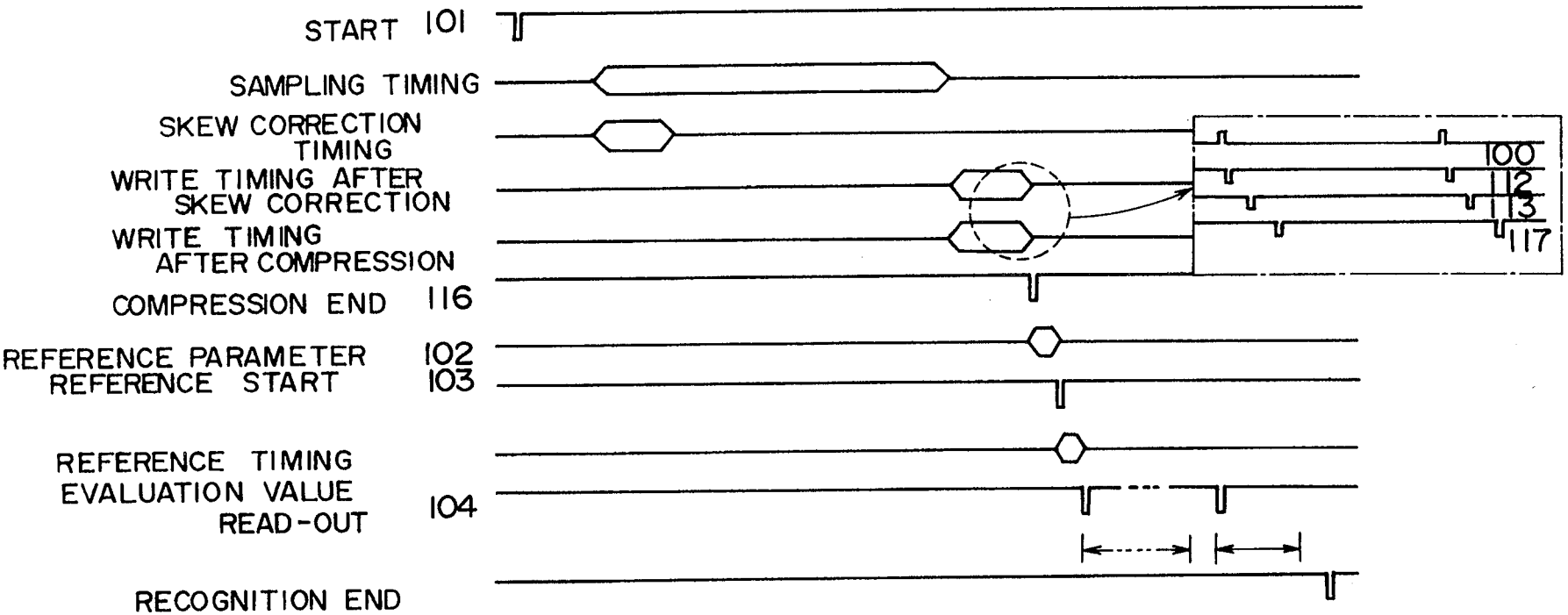
FIG. 5 is a timing chart to show the operation of the bill recognizing circuit in FIG. 1.
Figure 6:
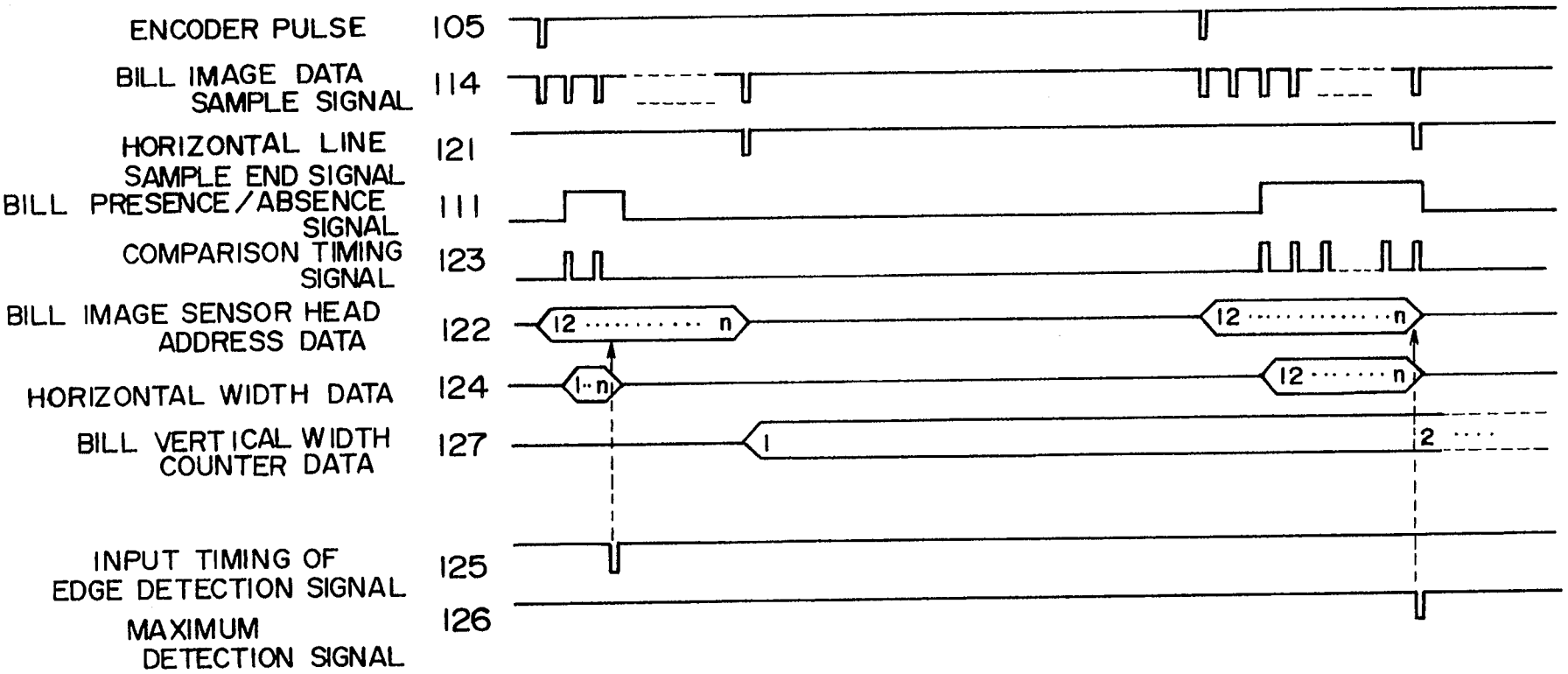
FIG. 6 is a timing chart to show the operation of the skew correction circuit in FIG. 2.

FIG. 5 shows a timing chart for the operation of the bill recognizing circuit 7 In FIG. 1. Shown in FIG. 6 is a timing chart for the operation of the skew correction circuit 10 in FIG. 2. An operation of the embodiment of the present invention will be described hereunder by reference to FIGS. 1 through 6.

When the edge of the bill passes the photo sensor 51, the bill recognizing circuit 7 is initialized by the bill recognizing processing start signal 101 from the photo sensor 51.

When the bill is fed to the image sensor 1, the address counter 4 starts operating. The bill sample data storage address generated by the address counter 4 is supplied to the storage memory 3 by way of the address selector 6, thereby initiating the writing operation in the storage memory 3 of the image data sampled by the image sensor 1.

Simultaneously with the writing operation into the storage memory 3, the skew correction processing is started by the skew correction circuit 10 and the address generation operation is performed for the skew correction by the skew correction circuit 10.

The address generation operation for skew correction is carried out as follows: Firstly, subtracted by the subtraction circuit 43 is the head position when the edge of the bill covers the image sensor 1 and the head position covered by the bill when the bill is fed to reach the maximum horizontal width. The skew correction constant is generated by the divider circuit 45 to divide the subtracted value from the subtraction circuit 43 and the bill vertical width counter data 127 generated by the vertical width counter 44.

Then, the skew correction constant generated by the divider circuit 45 is added by the calculation circuit 50 to the bill sample data writing address generated by the address counter 49. The address becomes the skew corrected bill sample data writing address 115.

The skew correction is completed by writing the bill sample data read out of the storage memory 3 in the address in the storage memory 11 designated by the skew corrected bill sample data writing address 115 from the skew correction circuit 10.

The skew corrected bill sample data read out of the storage memory 11 is compressed and added by the adder 12 for extracting its features. The bill compressed sample data is stored in the storage memory 19. It is to be noted here that the writing operation of the bill sample data in the storage memory 11 and that of the bill compressed sample data in the storage memory 19 are carried out in real time at the high speed in synchronism with the bill recognizing master clock signal 100.

When completing the compression operation of the skew corrected bill sample data from the storage memory 11, the bill compression end signal 116 is sent to the CPU from the counter 13.

On receiving the bill compression processing completion signal 116 from the counter 13, the CPU sets the reference parameter 102 to the bill recognizing circuit 7 for selecting the dictionary data and sends the reference start signal 103 to the bill recognizing circuit 7 for instructing the comparison with the dictionary data stored in the dictionary data storage memory 21.

On receiving the reference start signal 103 from the CPU, the bill recognizing circuit 7 starts comparing the bill compressed sample data stored in the storage memory 19 and the dictionary data stored In the dictionary data storage memory 21. The reference processing is performed for the entire compressed sample data for one bill. The comparator circuit 22 subtracts to compare the entire sample data and the dictionary data for the one bill.

The sum of the subtracted result between the entire sample data and the dictionary data for one bill is calculated by the adder 23 to obtain the evaluation value. In other words, the evaluation value will be smaller if the bill sample data is closer to the dictionary data. When the evaluation value is determined, the CPU sends the evaluation value read-out signal 104 to the bill recognizing circuit 7 so that the evaluation value data 118 can be read out of the bill recognizing circuit 7.

The above mentioned reference or comparison processing is performed for the dictionary data of all kinds of bill and the resulting evaluation value for each dictionary data is compared by sorting processing to determine the closest bill in the dictionary data.

As described hereinbefore, the bill recognizing circuit 7 is configured as a hardware so as to perform at a high speed in synchronism with the master clock signal 100 for the bill recognizing operation all processings to read the bill sample data from the storage memory 3, to correct the skew of the bill sample data by the skew correction circuit 10, to compress the skew corrected bill sample data by the adder 12, and to compare the compressed bill sample data and the dictionary data by the comparator circuit 22 and the adder 23. As a result, the bill recognizing circuit 7 can reduce each processing time.

The reduced time for judging the kind of bill contributes to shorten the distance to the feed path switching valve 57 to switch the feed path depending on the recognized bill thereby minimizing the bill recognizing apparatus.

Although the above description was made on one preferred embodiment of the present invention, it will be understood for a person having an ordinary skill in the art that various modifications can be made without departing from the scope and spirit of the present invention.

What is claimed is:

1. A bill recognizing apparatus comprising:

storage means to store an image data read from a transferred bill in response to a sampling clock;

generation means to generate a master clock faster than the sampling clock;

calculation means operable in synchronism with the master clock generated from said generation means to calculate the skew of the bill;

skew correction means operable in synchronism with the master clock to perform skew correction of the image data stored in said storage means in response to the calculation result from said calculation means;

compression means operable in synchronism with the master clock to compress the image data skew corrected by said skew correction means; and reference means operable in synchronism with the master clock to compare the image data compressed by said compression means and a preset dictionary data;

thereby recognizing the particular bill from the comparison result of said reference means in synchronism with the master clock.

2. A bill recognizing apparatus comprising:

a photo sensor for detecting an edge of the bill;

an image sensor for obtaining image data of the bill;

a storage memory for storing the image data obtained by said image sensor;

a skew correction circuit for performing a skew correction simultaneously with a writing operation into said storage memory at a specified address;

a dictionary data storage memory for storing dictionary data corresponding to all kinds of bills;

a bill recognition circuit for comparing skew corrected bill sample data read out of said storage memory with dictionary data corresponding to all kinds of bills stored in said dictionary data storage memory and determining the closest bill in the dictionary data as the recognition result; and wherein said specified address for the skew correction is generated from a circuit comprising, a subtraction circuit for subtracting a head position of the bill when the edge of the bill covers said image sensor and a head position covered by the bill when the bill is fed to reach the maximum horizontal width, a divider circuit for dividing the subtracted value from said subtraction circuit and the bill vertical width obtained by a bill vertical width detector to produce a skew correction constant and address circuit for adding said skew correction constant to the bill sample data writing address to generate said specified address.

* * * * *

UNITED STATES PATENT AND TRADEMARK OFFICE

CERTIFICATE OF CORRECTION

PATENT NO. : 5,363,949

DATED : November 15, 1994

INVENTOR(S) : Katsuyoshi MATSUBAYASHI

It is certified that error appears in the above-identified patent and that said Letters Patent is hereby corrected as shown below:

Column 1, line 48, after "causes", insert --problems in providing--;

Column 5, line 33, delete "Is", and insert --is--.

Signed and Sealed this

Twenty-eight Day of March, 1995

*Attest:*

*Attesting Officer*

BRUCE LEHMAN

*Commissioner of Patents and Trademarks*